US007581714B2

(12) United States Patent
Machu

(10) Patent No.: US 7,581,714 B2
(45) Date of Patent: Sep. 1, 2009

(54) DEVICE FOR HANDLING A STRUCTURE THAT IS BEING LIFTED OR LOWERED

(75) Inventor: Franck Machu, Fresnay en Retz (FR)

(73) Assignee: Hydralift-BLM, Carquefou (FR)

( * ) Notice: Subject to any disclaimer, the term of this patent is extended or adjusted under 35 U.S.C. 154(b) by 67 days.

(21) Appl. No.: 11/883,060

(22) PCT Filed: Jan. 27, 2006

(86) PCT No.: PCT/FR2006/050068

§ 371 (c)(1),
(2), (4) Date: Oct. 4, 2007

(87) PCT Pub. No.: WO2006/079759

PCT Pub. Date: Aug. 3, 2006

(65) Prior Publication Data

US 2008/0116427 A1 May 22, 2008

(30) Foreign Application Priority Data

Jan. 28, 2005 (FR) ..... 05 00899

(51) Int. Cl.
*B66F 3/02* (2006.01)

(52) U.S. Cl. ..... 254/97; 254/100

(58) Field of Classification Search ..... 254/95, 254/93 L, 100, 103, 105, 92
See application file for complete search history.

(56) References Cited

U.S. PATENT DOCUMENTS

| | | | | |
|---|---|---|---|---|
| 4,022,429 | A | 5/1977 | Yonekura et al. | |
| 4,443,000 | A * | 4/1984 | Harvard | 254/89 R |
| 4,901,982 | A * | 2/1990 | Havard et al. | 254/95 |
| 5,139,366 | A * | 8/1992 | Choate et al. | 405/198 |
| 6,039,508 | A * | 3/2000 | White | 405/232 |
| 6,431,795 | B2 * | 8/2002 | White | 405/232 |
| 6,581,910 | B1 * | 6/2003 | Granata | 254/95 |

FOREIGN PATENT DOCUMENTS

FR 2753466 3/1998

* cited by examiner

*Primary Examiner*—Lee D Wilson
(74) *Attorney, Agent, or Firm*—Young & Thompson

(57) ABSTRACT

An operating includes a rack cut on both sides, sandwiched between two pinions with horizontal axes and arranged in the same horizontal plane or substantially in the same horizontal plane, driven into opposite directions by the same motorized system. The outlet shaft of the motorized system transmits the driving motion to a primary reducing system whose outlet shaft corresponds to the inlet shaft of a secondary reducing gear of planetary differential type including a solar pinion, satellite pinions and an outer ring. The satellite holder of the secondary differential reducing gear drives one of the pinions on one of the sides of the double rack, and the outer ring of the planetary reducing gear drives, by appropriate mechanical elements, a toothed wheel in charge of driving the second pinion on the other side of the double rack.

10 Claims, 2 Drawing Sheets

DEVICE FOR HANDLING A STRUCTURE THAT IS BEING LIFTED OR LOWERED

The present invention relates to a device for raising or lowering a structure, for instance a plat-form such as an off-shore rig.

The off-shore drilling rigs include generally several fixed vertical legs fitted with racks. The raising and lowering installations, integral with the mobile rig, include motorised pinions rolling over these racks for ensuring raising and lowering manoeuvres.

The operating devices known until now are generally complex and cumbersome. Moreover, in certain configurations, the loads on the pinions vary according to the position and the lateral displacement of the rack.

This invention intends to remedy these shortcomings while offering an operating device of simple structure, little cumbersome and limited in weight, which moreover provides good distribution of the loads.

According to the present invention, the operating device includes a symmetrical rack, cut on both sides, sandwiched between two leading pinions with horizontal axes and arranged in the same horizontal plane, or substantially in the same horizontal plane, driven into opposite directions by the same motorised system. The outlet shaft of the single motorised system transmits the driving motion to a primary reducing system whereof the outlet shaft corresponds to the inlet shaft of a secondary reducing gear of planetary differential type including a solar pinion, satellite pinions and a outer ring; the satellite holder of said secondary differential reducing gear drives one of said leading pinions on one of the sides of said double rack, and the outer ring of said planetary reducing gear drives, by appropriate mechanical means, a toothed wheel in charge in turn of driving the second leading pinion, on the other side of said double rack.

Consequently, the pinions motorised are load- and speed-synchronised. It should be noted that it is possible pile up different devices, identical or similar, to increase the lifting capacity.

The outer ring of the planetary reducing gear is preferably toothed externally, and the mechanical linking means between said outer ring and the toothed wheel for driving the second leading pinion consist of a driving chain or of one or several idle pinions.

Moreover, the leading pinion of the rack interconnected with the toothed wheel driven by the secondary reducing gear is advantageously fitted with a load measuring system, preferably placed on the side of said toothed wheel.

The invention will be illustrated further, without being limited in any way by the following description of two particular embodiments, given solely by way of example, and represented on the appended drawings wherein.

Figure 1:
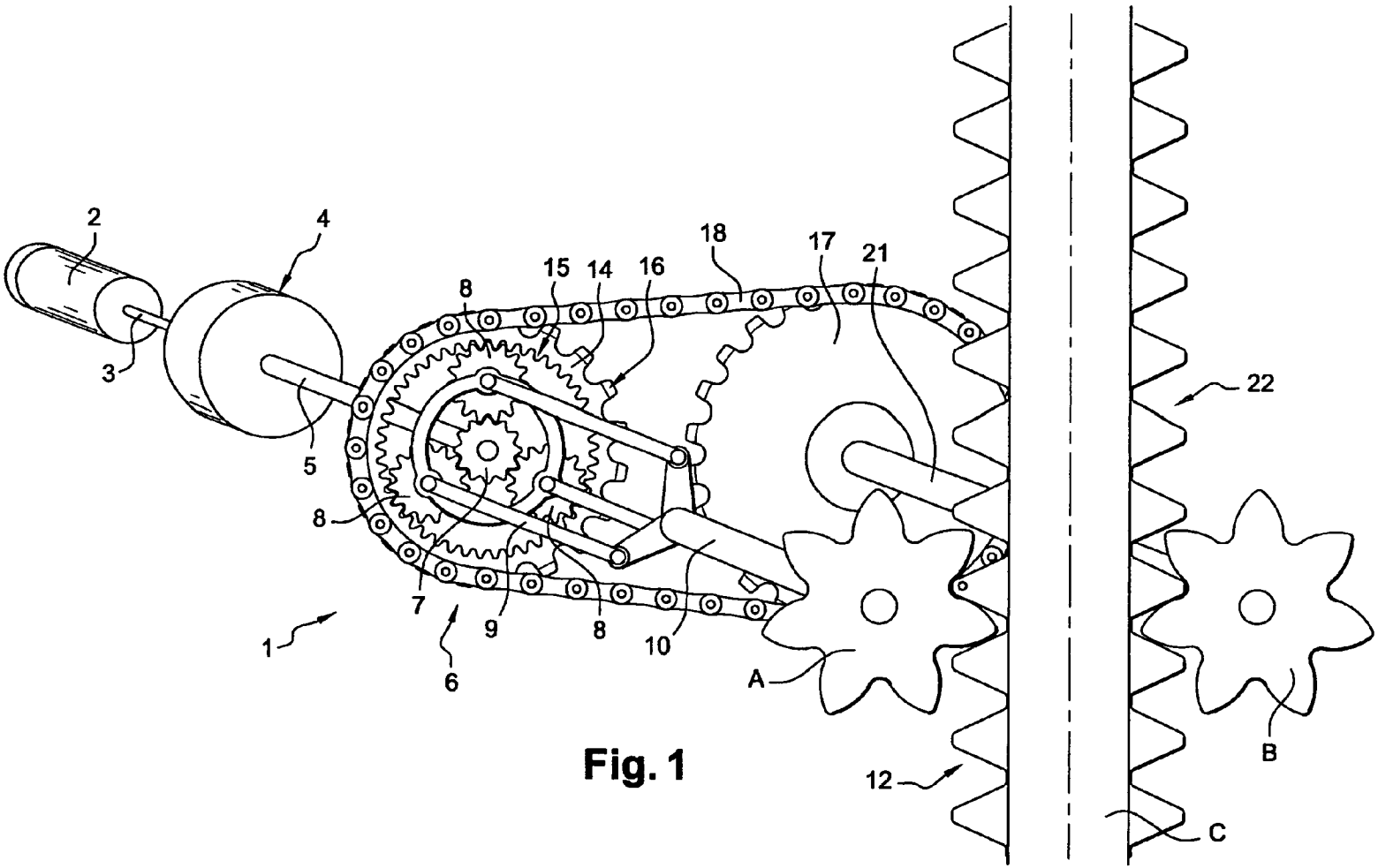
FIG. 1 is a diagrammatical view of a first embodiment of the operating device according to the invention, wherein the secondary reducing gear drives the toothed wheel of the second leading pinion via a chain.

The operating device 1 illustrated on FIG. 1 contains mainly two pinions A and B driven into rotation by the same motorised system 2 and which sandwich a double rack C. The structure manoeuvred can be a mobile platform, which has not been represented by way of simplification. Also, the support of the double rack C, for instance a vertical leg, has not been represented either.

More precisely, the operating device 1 includes a motorised system 2 of hydraulic or electric type whereof the outlet shaft 3 corresponds to the inlet shaft of a primary reducing system, represented diagrammatically in 4, which may be fitted with parallel gear trains or epicycloidal gear trains.

The outlet shaft 5 of the primary reducing gear 4 corresponds to the inlet shaft of a secondary reducing gear 6 of planetary differential type with two outlets.

The inlet solar pinion 7 of this secondary reducing gear 6 is directly driven by the inlet shaft 5. This solar pinion 7 drives three satellite pinions 8 connected by a satellite holder 9 whereof the outlet shaft 10 drives directly the first pinion A which meshes into one of the sides 12 of the double fixed rack C.

The satellite pinions 8 drive the external ring 14 of the secondary reducing gear 6 via an internal toothing 15, and the external toothing 16 of the ring 14 drives a toothed wheel 17, via a transmission chain 18; this toothed wheel 17 drives directly the second leading pinion B via a shaft 21.

This second pinion B meshes into the side 22 of the double rack 13.

Both pinions A and B which mesh into both opposite sides 12 and 22 of the rack C have horizontal rotational axes which are situated in the same horizontal plane, or substantially in the same horizontal plane.

The reducing ratios between the toothed wheel 17 and the outer ring 14 of the secondary reducing gear 6 are such as the loads on both pinions A and B are close to one another.

Both outlets of the planetary reducing gear 6 have a differential movement and rotate in reverse direction. Both these portions develop rigorously proportional loads, one responding to the other.

This particularity is a notable improvement on certain prior realisations for which the loads on both leading pinions vary according to the position and the lateral displacement of the rack.

On the other hand, a measuring system may be provided on one of the two leading pinions A, B of the double rack C, more advantageously on the pinion B driven by the toothed wheel 17. This measuring system, not represented, is placed advantageously on the side of the toothed wheel 17, inside the hollow axis 21 provided.

The structure of the lifting system defined above occupies a volume substantially reduced with respect to prior equipment; according to the type of device, the gain in volume may reach 30%.

Figure 2:
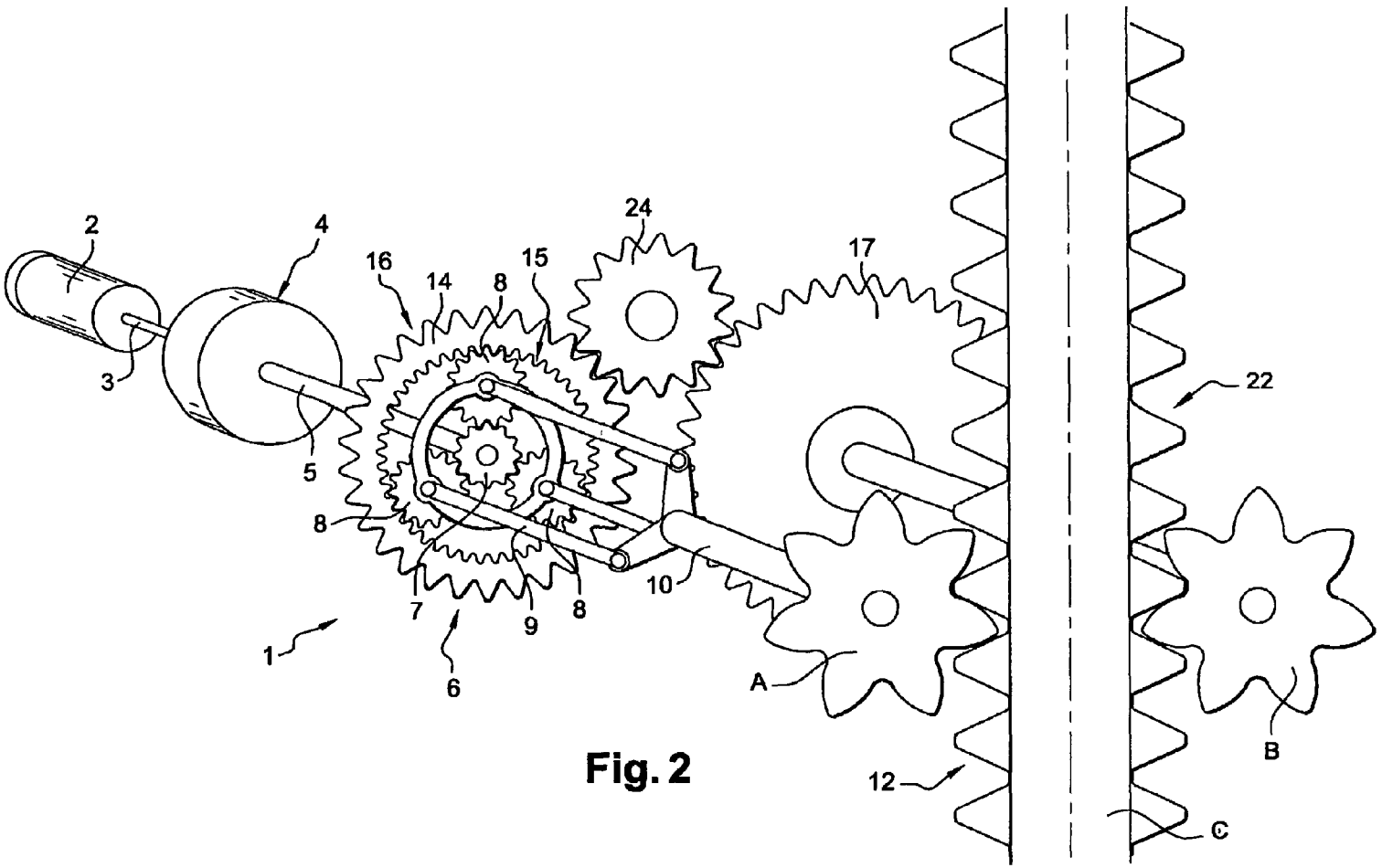
FIG. 2 illustrates an embodiment variation of the operating device, wherein the linking mechanical system between the secondary reducing gear and the wheel for driving the second leading pinion is formed of an idle pinion.

FIG. 2 illustrates an embodiment variation of the operating device illustrated on FIG. 1.

Here, the transmission of the movement between the outer ring 14 of the secondary reducing gear 6 and the toothed wheel 17 is performed by an idle pinion marked 24.

All the other mechanical elements are identical to those of FIG. 1 and operate similarly.

The invention claimed is:

1. A device for operating a structure by raising and lowering the structure relative to a support, by means of motorised pinions (A,B) integral with said structure, meshing into a fixed vertical rack (C) integral with said support, said device including a rack (C) cut on both sides (12,22), sandwiched between two leading pinions (A,B) with horizontal axes and arranged in substantially in the same horizontal plane, driven into opposite directions by a motorised system (2), wherein an outlet shaft (3) of said motorised system (2) transmits the driving motion to a primary reducing system (4) and an outlet shaft (5) of the reducing system (4) serves as an inlet shaft of a secondary reducing gear (6) of a planetary differential type including a solar pinion (7), satellite pinions (8) and an outer ring (14), wherein a satellite holder (9) of said secondary differential reducing gear (6) drives one of said pinions (A), on one of the sides (12) of said double rack (C), and the outer ring (14) of said planetary reducing gear (6) drives by a mechanical linking means (18, 24), a toothed wheel (17) in charge in turn of driving the second pinion (B) on the other side (22) of said double rack (C).

2. A device according to claim 1, characterised in that the outer ring (14) of the planetary reducing gear (6) includes an external toothing (16), wherein the mechanical linking means between said ring (14) and the toothed wheel (17) for driving the second motorised pinion (B) are formed of a chain (18).

3. A device according to claim 1, characterised in that the outer ring (14) of the planetary reducing gear (6) includes an external toothing (16), wherein the mechanical linking means between said ring (14) and the toothed wheel (17) for driving the second motorised pinion (B) are formed of at least one idle pinion (24).

4. A device according to claim 1, further comprising a system for measuring the load applied on the pinion (B) driven by the toothed wheel (17), which measuring system is placed on the side of said toothed wheel (17).

5. An installation for operating a structure by and lowering the structure relative to a support, which installation is formed of plural devices (1) according to claim 1, at least one of the plural devices positioned on top of another of the plural devices.

6. A device according to claim 2, further comprising a system for measuring the load applied on the pinion (B) driven by the toothed wheel (17), which measuring system is placed on the side of said toothed wheel (17).

7. A device according to claim 3, further comprising a system for measuring the load applied on the pinion (B) driven by the toothed wheel (17), which measuring system is placed on the side of said toothed wheel (17).

8. An installation for operating a structure by and lowering the structure relative to a support, which installation is formed of plural devices (1) according to claim 2, at least one of the plural devices positioned on top of another of the plural devices.

9. An installation for operating a structure by raising and lowering the structure relative to a support, which installation is formed of plural devices (1) according to claim 3, at least one of the plural devices positioned on top of another of the plural devices.

10. An installation for operating a structure by raising and lowering the structure relative to a support, which installation is formed of plural devices (1) according to claim 4, at least one of the plural devices positioned on top of another of the plural devices.

* * * * *